US007410400B2

(12) United States Patent
Staudinger

(10) Patent No.: US 7,410,400 B2
(45) Date of Patent: Aug. 12, 2008

(54) MOTORIZED WATERCRAFT INCLUDING BOARD BANKING STEERING MECHANISM

(76) Inventor: Lyn Staudinger, 504 Ventaja, Newport Beach, CA (US) 92660

( * ) Notice: Subject to any disclaimer, the term of this patent is extended or adjusted under 35 U.S.C. 154(b) by 0 days.

(21) Appl. No.: 11/541,394

(22) Filed: Sep. 29, 2006

(65) Prior Publication Data

US 2007/0084392 A1 Apr. 19, 2007

Related U.S. Application Data

(60) Provisional application No. 60/722,836, filed on Sep. 30, 2005.

(51) Int. Cl.
*A63C 5/03* (2006.01)

(52) U.S. Cl. ..... 441/74; 114/123

(58) Field of Classification Search ..... 441/74, 441/65; 114/61.1, 123
See application file for complete search history.

(56) References Cited

U.S. PATENT DOCUMENTS 3,143,996 A 8/1964 Chapman
3,150,632 A 9/1964 Evans
3,340,845 A 9/1967 Tyrack
3,405,677 A 10/1968 Smith
3,414,919 A * 12/1968 Gust ..... 441/74
4,274,357 A 6/1981 Dawson
4,688,504 A 8/1987 Sulz et al.
4,700,648 A 10/1987 Trefethern et al.
4,807,551 A * 2/1989 Ace ..... 114/123
6,192,817 B1 2/2001 Dec et al.
6,347,599 B1 2/2002 Hendrickson
6,409,560 B1 6/2002 Austin
6,568,340 B2 5/2003 Dec et al.
6,901,872 B1 6/2005 Battle et al.
2003/0167991 A1 9/2003 Namanny
2005/0221695 A1 * 10/2005 Otobe et al. ..... 440/49

FOREIGN PATENT DOCUMENTS

EP 0350599 5/1989

* cited by examiner

*Primary Examiner*—Stephen Avila
(74) *Attorney, Agent, or Firm*—William G. Lane

(57) ABSTRACT

A board-based motorized watercraft may be steered by banking the board section to yaw the motor. The motorized watercraft includes a pair of pontoons connected by a beam for enhanced stability. The motor is mounted between the pontoons to the beam. The board section may rotate with respect to the pontoons and the beam. A steering mechanism couples the rotation of the board section with yawing of the motor, allowing a user to steer the watercraft by leaning to rotate the board.

15 Claims, 13 Drawing Sheets

MOTORIZED WATERCRAFT INCLUDING BOARD BANKING STEERING MECHANISM

CROSS-REFERENCE TO RELATED APPLICATION

This application claims the benefit of U.S. Provisional Patent Application No. 60/722,836, entitled "MOTORIZED WATERCRAFT INCLUDING BOARD BANKING STEERING MECHANISM," filed on Sep. 30, 2005.

Also, this application hereby incorporates by reference the above-identified provisional application, in its entirety.

BACKGROUND OF THE INVENTION

1. Field of the Invention

This application relates generally to motorized personal watercraft, and, more specifically, to motorized personal watercraft whose motor may be steered by banking a board in the desired direction of a turn.

2. Description of the Related Art

Motorized watercraft provide recreation and enjoyment for many users and have recently become increasingly popular. Conventional motorized watercraft are essentially miniature boats allowing a rider to sit or stand on a boat-like hull. Stability to these watercraft are provided by the hull configuration and buoyancy. Typically a rider steers one of these watercraft by rotating handlebars coupled to a pivotable nozzle that vectors a jet of water from an inboard motor in a selected direction. The operation and ride of these watercraft, therefore, is akin to a small maneuverable boat.

Many riders, especially those accustomed to board sports such as surfing or windsurfing, are disappointed with the performance of conventional watercraft and would prefer the enhanced control and maneuverability inherent in controlling a board's movement by shifting one's balance. Therefore, a need exists for a motorized board-based watercraft. However, simply integrating a motor to a surfboard-like board has resulted in unstable watercraft that are likely to injure a rider. Therefore, a need exists for a motorized board-based watercraft with enhanced stability.

Several attempts have been made to create stable motorized board watercraft. However, these attempts have had serious shortcomings. Notably, the attempts have added stability to the board by rigidly affixing outrigger floats to the board. This addition of outriggers to a board has increased stability of the board at the expense of maneuverability and control of the board. Thus, these board and outrigger watercraft are unable to deliver a board-like riding experience.

SUMMARY OF THE INVENTION

In various embodiments further described below, watercrafts are provided that overcome the shortcomings noted above. Specifically, motorized watercrafts are provided that have enhanced stability while maintaining a board-like riding experience.

In some embodiments, a board-based motorized watercraft is provided that comprises a board section, an aft section, a motor, and a steering mechanism. The board section has a longitudinal axis. The board section forms a bow of the watercraft. The aft section of the watercraft comprises a starboard pontoon, a port pontoon, a beam spanning from the starboard pontoon to the port pontoon, and a motor mount box. The motor mount box is mounted to the beam. The motor mount box includes a motor mount plate. The motor mount box provides a rotatable connection between the board section and the aft section of the watercraft such that the board section is rotatable about the longitudinal axis with respect to the aft section and such that the pontoons provide buoyancy and enhanced stability to the board section. The motor is pivotally mounted to the motor mount plate such that the motor is yawable with respect to the beam. The steering mechanism couples a rotation of the board section relative to the beam section to a yaw angle of the motor relative to the beam such that rotation of the board about its longitudinal axis yaws the motor in a direction corresponding to a desired direction of a turn. Thus, the watercraft provides a board-like riding experience In certain embodiments, motorized watercrafts comprising a board section, at least one pontoon, a beam connected to the at least one pontoon, a motor mounted to the beam, and a steering mechanism for yawing the motor to steer the watercraft are provided. The board section is rotatably mounted to the beam such that the board section is rotatable about its longitudinal axis. The steering mechanism couples the rotation of the board section with the yaw of the motor such that rotating the board about its longitudinal axis yaws the motor.

In other embodiments, steering mechanisms for use on a motorized watercraft having a board section that is rotatable about a longitudinal axis and a motor that is yawable with respect to the watercraft to steer the watercraft are provided. The steering mechanisms comprise a first cable, a second cable, a first cable router, and a second cable router. The first cable has a first end and a second end. The first end of the first cable is configured to be affixed to a first side of the board section of the watercraft and the second end of the first cable is configured to be affixed to a first side of the motor of the watercraft. The second cable has a first end and a second end. The first end of the second cable is configured to be affixed to a second side of the board section of the watercraft and the second end of the second cable is affixed to a second side of the motor. The first cable router is configured to be mounted to the watercraft to route the first cable between the board section and the motor. The second cable router is configured to be mounted to the watercraft to route the second cable between the board section and the motor. The steering mechanism is configured to couple rotation of the board section about its longitudinal axis with yaw of the motor to steer the watercraft.

In still other embodiments, methods for steering a motorized watercraft comprising a board section rotatably coupled to a stabilization section, a motor yawably coupled to the stabilization section, and a steering mechanism coupling the board section to the motor are provided. The methods comprise the step of rotating the board section of the watercraft relative to the stabilization section of the watercraft such that the steering mechanism of the watercraft yaws the motor of the watercraft.

DETAILED DESCRIPTION OF THE PREFERRED EMBODIMENT

Turning now to FIGS. 1-4, a motorized watercraft according to various embodiments of the present inventions is illustrated. In the embodiments illustrated, the watercraft comprises a board section 100, rotatably coupled to a stabilization section. In the illustrated embodiments, the stabilization section comprises a port pontoon 104*a*, a starboard pontoon 104*b*, a beam 102 connecting the pontoons 104*a*, 104*b* to the board section 100, a motor 106, and a steering mechanism 108. Each of these components is discussed in more detail below.

Board Section

As depicted, the board section 100 defines the bow of the watercraft. The board section 100 may be shaped similarly to a conventional surfboard, having slightly curved upper and lower surfaces. Alternately, the board section 100 may be shaped similarly to a boat hull, having contoured ribs on the lower surface. As discussed further below, it is contemplated that board sections of various sizes and shapes can be used in the watercraft described herein. The board section 100 may provide a standing or sitting surface for one or more riders of the watercraft.

The board section 100 can be constructed using known materials and techniques including those used in hull building and surfboard building. For example, the board section 100 may be a resin or fiberglass shell surrounding a lightweight frame and a foam core. A board such as a surfboard may be modified for use as a board section 100 in a watercraft. The modification can include building up the thickness of the surfboard by adding an additional layer or layers of foam to an upper and/or lower surface of the board section 100. Advantageously, these additional layers, if on the upper surface, may provide a comfortable standing surface for a rider. Likewise, if on the lower surface, additional foam layers may advantageously provide a shock buffer to the structure of the board section 100 should the board section 100 strike a submerged object or run aground during operation.

Figure 11:
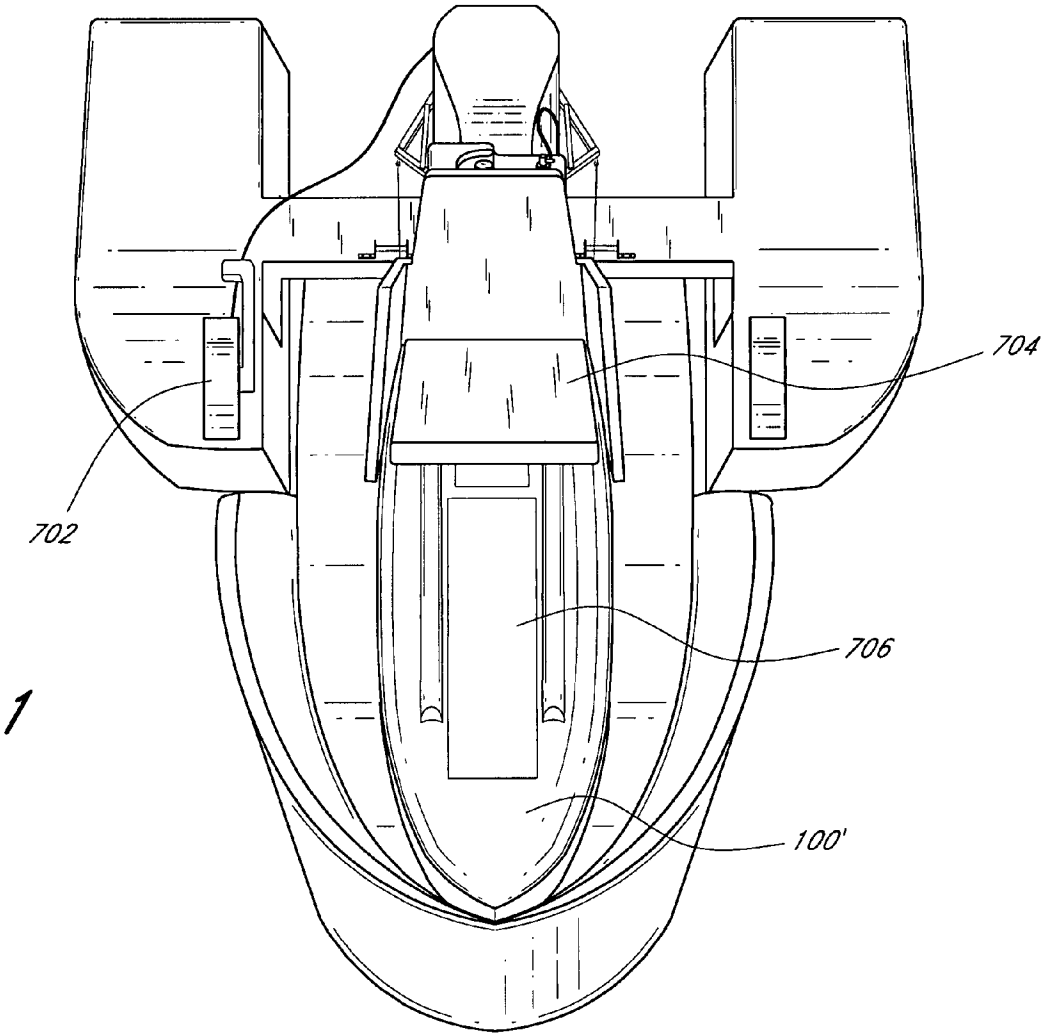
FIG. 11 is a front perspective view of another embodiment of watercraft configured for operation by a seated rider.

In some embodiments, the board section 100 can include a storage compartment. The storage compartment can be, for example, a recessed area in the board section 100' that is accessible through a door 706 or panel that is hingedly coupled to the board (FIG. 11). Desirably, the hinged door section can be located in an upper surface of the board 100' such that the storage compartment is easily accessible to the rider. The hinged door 706 section and board can include a latch or lock such to reduce the risk that the storage compartment inadvertently opens while the watercraft is in motion. The hinged door 706 section, or the recess can include a gasket or seal to substantially prevent water from entering the storage compartment when the door is closed.

Figure 4:
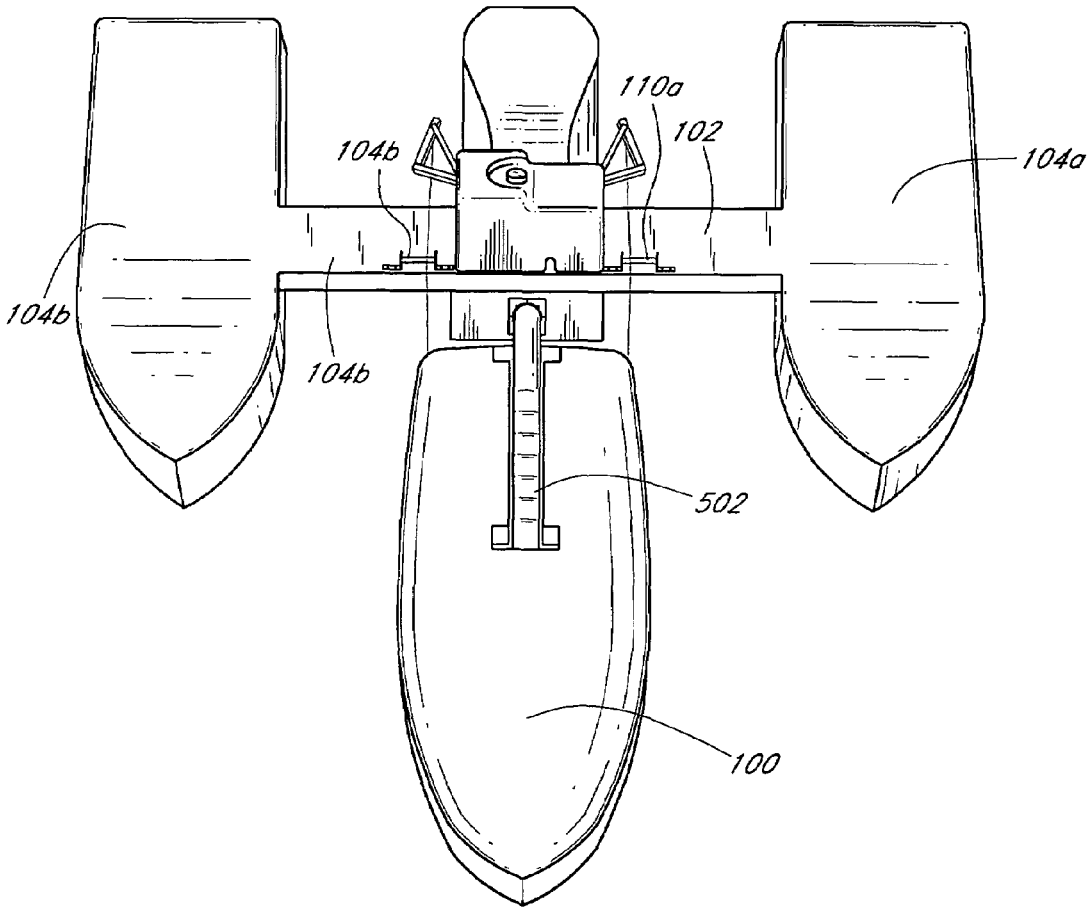
FIG. 4 is a front perspective of the watercraft of FIG. 1 with an access hatch removed to illustrate certain aspects thereof.

The board section 100 is configured to be rotatably connected to the stabilization section. In the illustrated embodiments, the board section 100 is configured to be rotatably coupled to the beam 102 connecting the port pontoon 104*a* and the starboard pontoon 104*b*. As illustrated, this rotatable connection comprises a tubular spine 502 (FIG. 4) running substantially parallel to the longitudinal axis of the board section 100, fixedly connected to the board section 100, and rotatably connected to the beam 102. The fixed connection to the board section 100 includes a portion where the tubular spine 502 may be crimped, effectively forming a splined connection with the board section 100 to resist rotation relative to the board section 100. The crimped section may be affixed to the board section 100 using conventional fasteners such as nuts and bolts. The tubular spine 502 may be integrated into the board section 100. As depicted in FIG. 4, the board section 100 includes a recessed area in which the tubular spine 502 is disposed. The recessed area is covered by a removable cover 140 such that the upper surface presents a generally uniform surface to a rider. In FIG. 4, the cover 140 has been removed to reveal the tubular spine inside the board. While the rotatable coupling of the board section 100 to the stabilization section has been depicted and described as having tubular spine with a fixed connection to the board section 100 and a rotatable connection to the beam 102, various alternate rotatable connections are possible. For example, a tubular spine could be rotatably connected to the board section 100 and fixedly connected to the beam 102, or a rotatable joint without a tubular spine can be used in some embodiments of watercraft.

In some embodiments, the rotatable connection to the beam 102 can include a bushing integrated in or connected to the beam 102 through which the tubular spine 502 passes. The bushing is preferably comprised of a material with a relatively low coefficient of friction and a relatively high wear life such as Delring® material by DuPont. Alternately, other bushing materials or bearings may be used in the rotatable connection.

In some embodiments, the board section 100 can be configured to be easily removable from the beam 102. Advantageously, this removability facilitates transportation of a watercraft as two smaller discrete components rather than a single, potentially cumbersome, device. A removable fastener known in the art such as a spring clip or removable pin may be included in the rotatable connection between the tubular spine 502 and the beam 102 to facilitate removability of the board section 100. Alternately, the board section 100 can be removed from the watercraft by accessing the tubular spine 502 by removing the cover 140 and removing fasteners such as nuts and bolts connecting the board section 100 to the tubular spine 502. Additionally, while a tubular spine 502 is depicted as removably connecting the board section 100 and the beam 102, this removable connection may alternately be provided by a pair of substantially parallel plates configured to clamp around the upper and lower surfaces of the board section 100 in a sandwich configuration. The clamping forces on the board section 100 may be adjusted by one or more fasteners such that the board section 100 may be easily removed.

Figure 10:
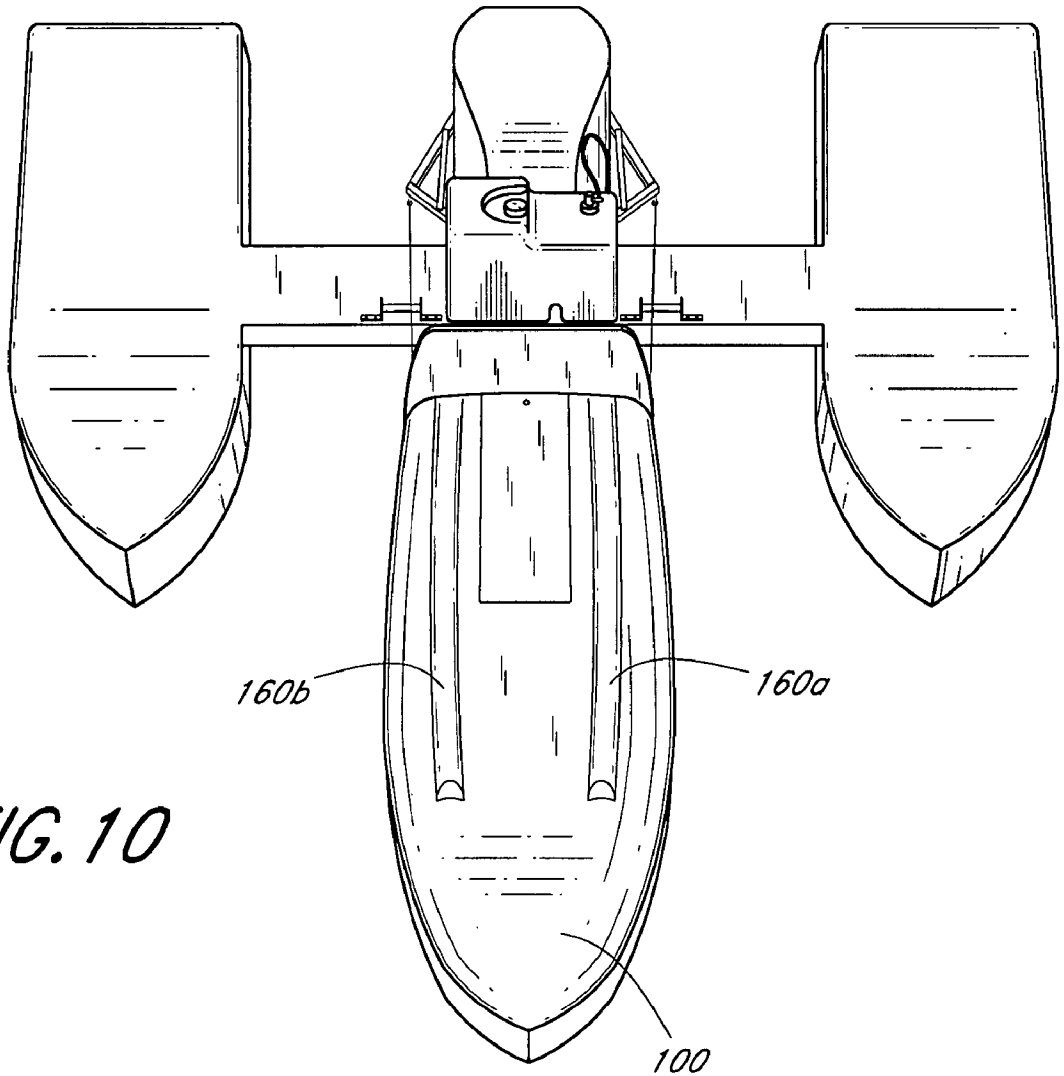
FIG. 10 is a front perspective view of an embodiment of watercraft including side rails on the board section.

In some embodiments, the board section 100 can also include one or more side rails. FIG. 10 depicts a board section 100 with two side rails 160*a*, 160*b*. Advantageously, the side rails reduce the risk of a rider falling overboard when the board section 100 is banked as the watercraft enters a turn. The side rails 160*a*, 160*b* can comprise a water resistant soft foam material adhered to an upper surface of the board section 100. The softness of the material of the side rails 160*a*, 160*b* should allow a rider to contact the side rails 160*a*, 160*b* with a relatively low risk of injury. Alternately, the side rails can be integrated into the upper surface of the board section 100. In this alternate configuration, the side rails can comprise the surface material of the board section 100, such as fiberglass.

Beam

Figure 1:
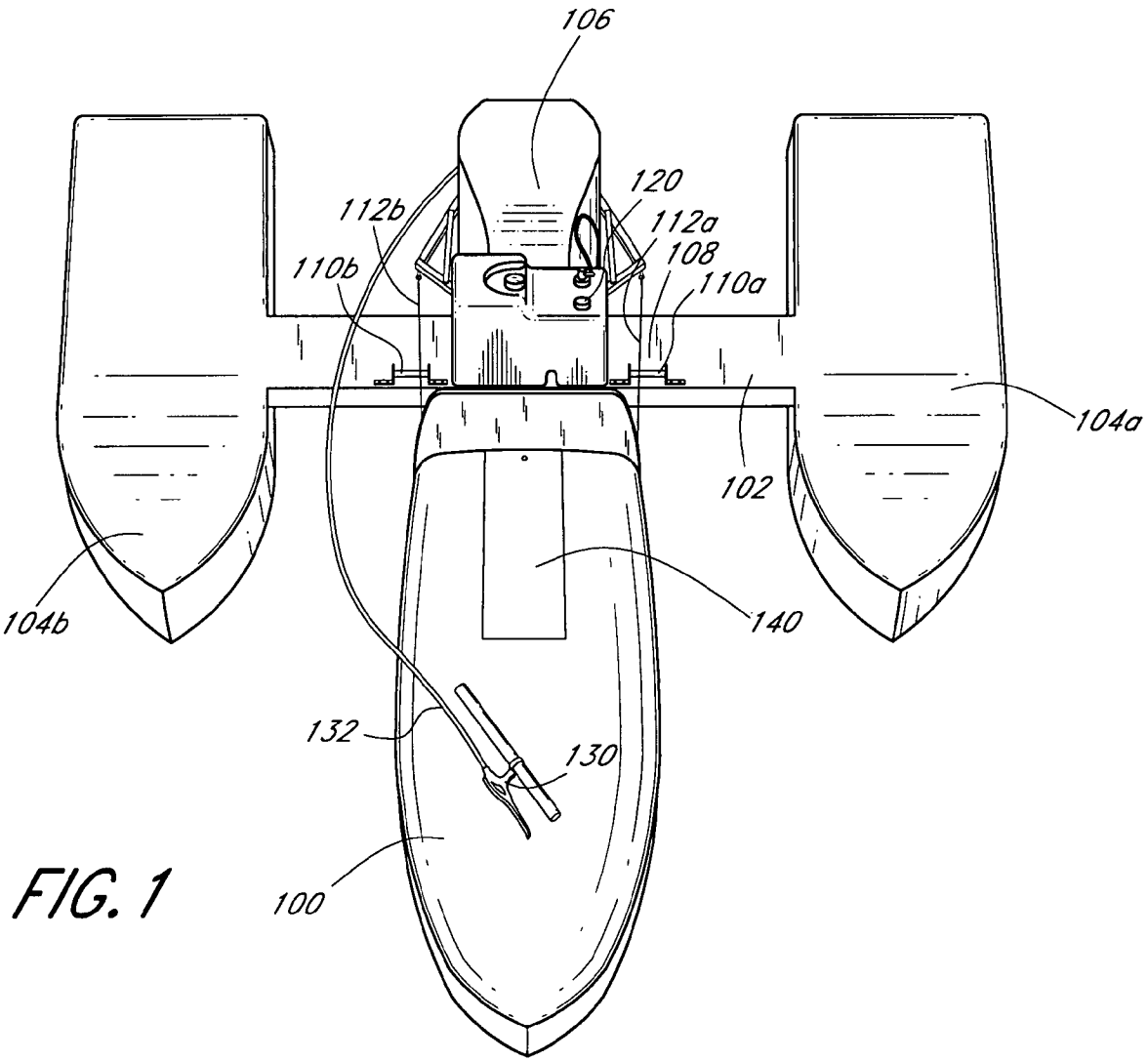
FIG. 1 is a front perspective view of one embodiment of watercraft.
Figure 2:
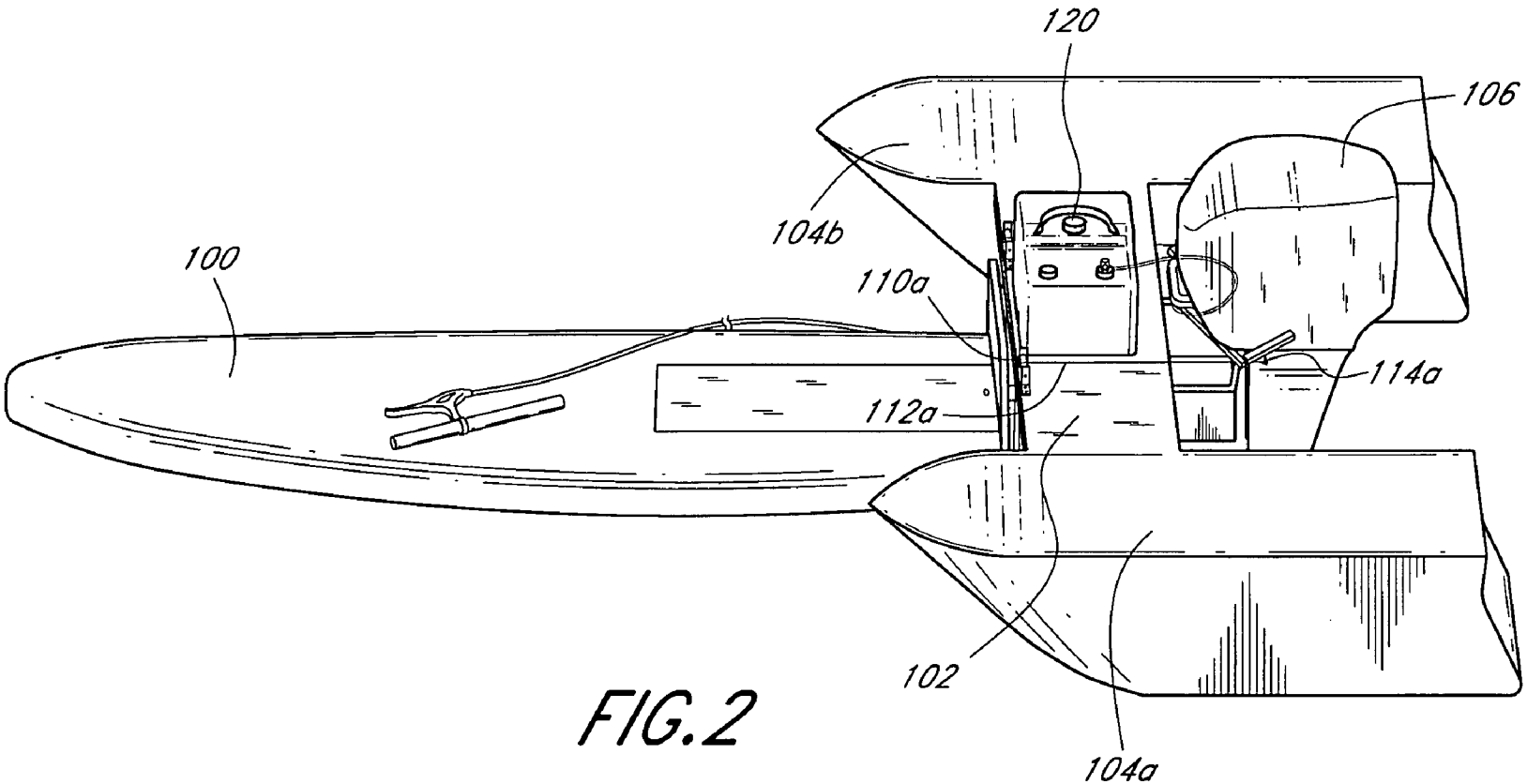
FIG. 2 is a side perspective view of the watercraft of FIG. 1.
Figure 3:
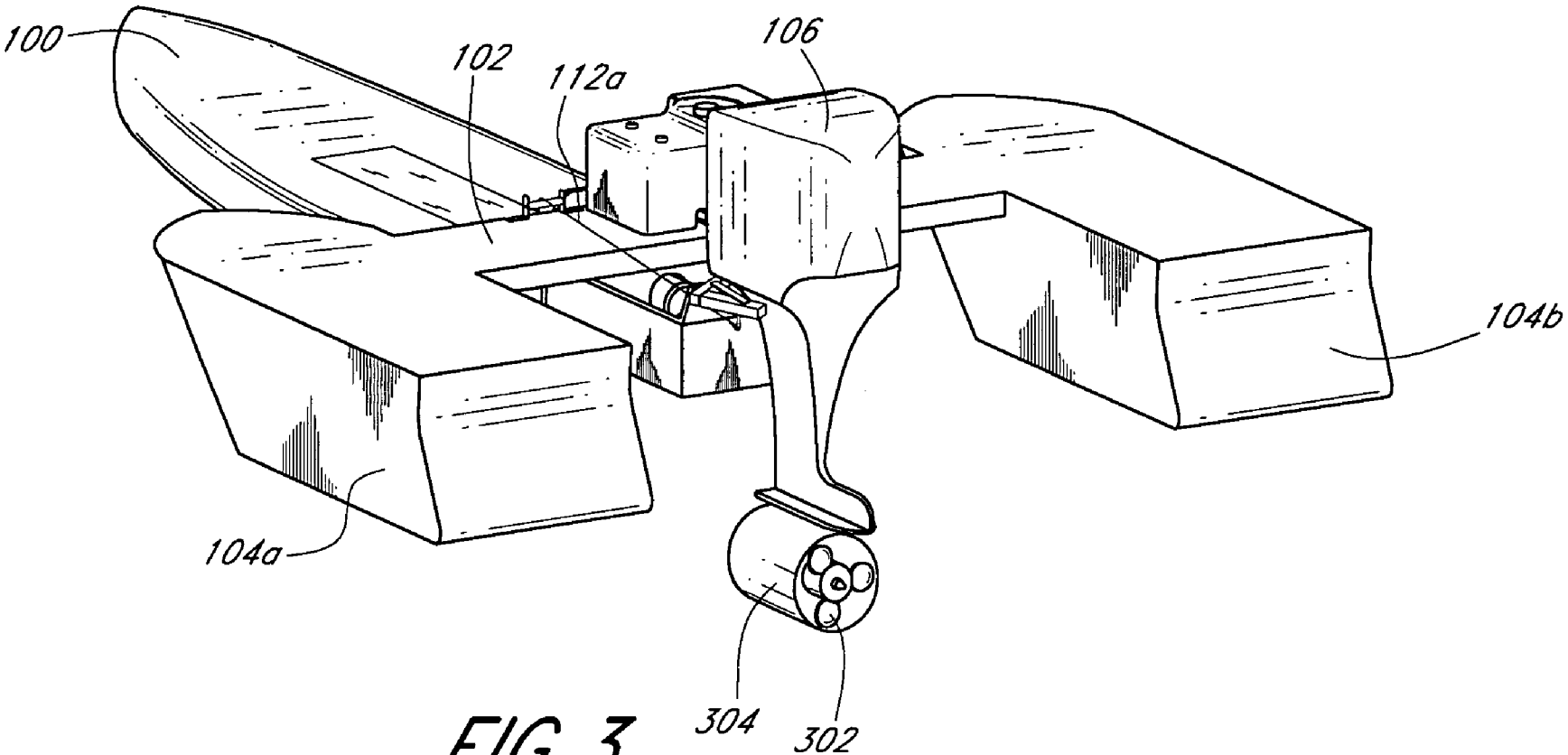
FIG. 3 is a rear perspective view of the watercraft of FIG. 1.

In the various embodiments of watercraft illustrated in FIGS. 1-4, 10, and 11, the stabilization section includes a beam 102 (FIG. 1). As noted above, the board section 100 is rotatably coupled to the beam 102. Also, as further discussed below, a port pontoon 104*a* and a starboard pontoon 104*b* are coupled to the beam 102 near a corresponding port end and starboard end of the beam 102. A motor 106 can be coupled to the beam 102. Thus, as illustrated, the beam 102 can form a central structural component of the watercraft. Additionally, the beam 102 can provide a standing or sitting surface for a rider of a watercraft. While this component has been termed a beam, it is recognized that in various embodiments, the beam can comprise other structures such as, but not limited to, multiple beams or a composite structure including support beams, foam, and fiberglass or resin. Moreover, in some embodiments, the beam can be integrally formed with the pontoons and or the motor mount. Such alternate compositions of the beam are contemplated to be within the scope of the watercrafts of the present invention.

Motor Mount Box

Figure 5:
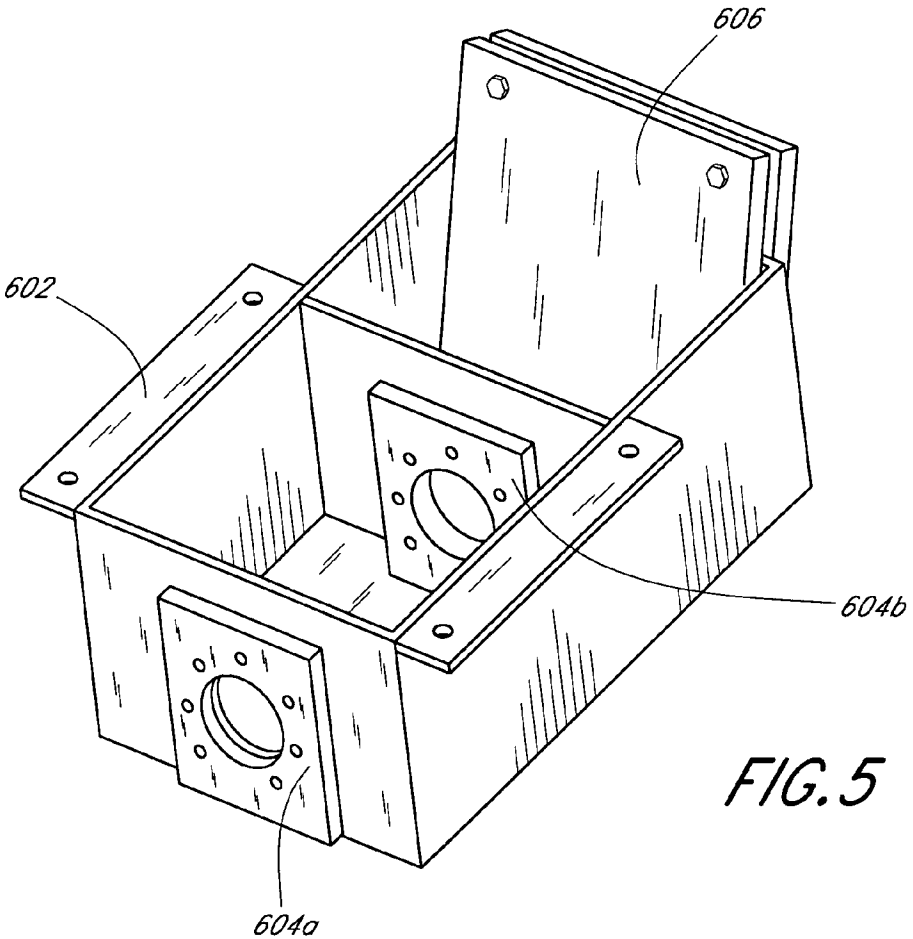
FIG. 5 is a perspective view of a motor mount box of the watercraft of FIG. 1.

With reference to FIG. 5, in the illustrated embodiments, the stability section of the watercraft comprises a motor mount box 602. As illustrated, the motor mount box 602 includes mounting points for the beam 102, the board section 100, and the outboard motor 106. In the illustrated embodiments, the motor mount box 602 is mounted to the beam 102 (FIG. 5). The motor mount box 602, depicted in a perspective view in FIG. 5, is desirably comprised of a strong, rigid material that resists corrosion when subjected to splashes and partial immersion in fresh or salt water. In one embodiment, the motor mount box 602 is comprised of ¼ inch thick aluminum, although in other embodiments different materials and material thicknesses can be used. The motor mount box 602 is configured to allow mounting of an outboard motor 106 to a mount plate 606 on the aft end of the box 602 by a clamped attachment. The motor mount box 602 can be mounted to the beam 102 structure spanning between a port pontoon 104*a* and a starboard pontoon 104*b* using conventional fasteners such as nuts and bolts. Alternately, the motor mount box 602 can be welded to a beam structure to form a single unitary beam with a motor mount. In still other embodiments, the motor mount can be integrally formed with the beam 102. While the beam 102 as illustrated includes a motor mount box 602 configured to allow clamped attachment of an outboard motor 106, it is recognized that alternate configurations of beam 102 may be better suited to alternate motor configurations. For example, an inboard motor or a jet drive motor may require a different size or shape of motor mount box, or may not require a motor mount box at all.

In the illustrated embodiment, the motor mount box 602 supports two bushings 604*a*, 604*b* to allow for rotatable connection between the beam 102 and the board section 100. In the illustrated embodiment, a fore bushing 604*a* is positioned in a fore wall of the motor mount box 602, and an aft bushing 604*b* is positioned in an aft wall of the motor mount box 602. These bushings 604*a*, 604*b* are configured to provide a rotatable connection between the tubular spine 502 of the board section 100 and the motor mount box 602. These bushings 604*a*, 604*b* are preferably composed of a material having lubricious properties such as a Delrin® material.

Pontoons

In the illustrated embodiments, the watercraft comprises a port pontoon 104*a* and a starboard pontoon 104*b* coupled to the beam 102 near corresponding port and starboard ends of the beam 102. However, it is recognized that a single pontoon or more than two pontoons could be included in other embodiments of watercraft and would be considered within the scope of the present invention.

The pontoons 104*a*, 104*b* desirably comprise a buoyant material. Preferably, the pontoons 104*a*, 104*b* comprise a foam core encapsulated in a fiberglass outer layer. The foam core may be built up of individual layers of foam sheets. This layered design may reduce manufacturing costs and complexities over other pontoon structures. Alternately, other materials may be used in the construction of the pontoons 104*a*, 104*b*. This preferred composition provides a highly buoyant and low weight structure. Buoyant pontoons, especially when spaced apart at port and starboard ends of the beam 102 provide enhanced stability to a board-based watercraft, and can limit rolling motion of the watercraft. Desirably, the pontoons 104*a*, 104*b* provide sufficient buoyancy to float the watercraft and one or more riders at a desired orientation where the motor 106 drive is submerged to a desired depth while the upper surface of the board section 100 and the upper surface of the beam 102 remain a desired amount above the waterline. The material composition (e.g., in foam core pontoons, the foam density and amount) of the pontoons 104*a*, 104*b* and the board section 100, and the relative positioning of the pontoons 104*a*, 104*b* and the board section 100 can be configured to provide a watercraft that has desirable dynamic operation characteristics such as stability through low and high speed turns and planning at high speed operation.

In some embodiments the pontoons 104*a*, 104*b* are desirably shaped with a contoured bow profile to reduce drag on the pontoons 104*a*, 104*b* as they travel through the water. This reduced drag may advantageously lead to higher top speeds, greater fuel efficiency, and reduced stresses on the watercraft while in operation. The pontoons 104*a*, 104*b* can additionally include ridges on their immersed surfaces similar to those on a conventional powerboat hull to provide additional stability, or reduced drag.

The pontoons 104*a*, 104*b* can also include recesses or storage compartments. For example, in certain embodiments, one or both of the pontoons 104*a*, 104*b* can include a recessed area configured to receive a fuel tank 120 to supply fuel to the motor 106. The other of the pontoons 104*a*, 104*b* can include an internal storage compartment to allow a rider to store tools, snacks, clothes, towels, or other items. As noted above, in some embodiments, the board section 100 can also include a storage compartment.

Motor

In various embodiments, the watercraft includes a motor 106 attached to the beam 102. As illustrated, the motor 106 is an outboard motor clampedly attached to a motor mount box 602 on the beam 102. The outboard motor can include a propeller guard 304 to prevent accidental injury by the spinning propeller 302. In alternate embodiments, various configurations of inboard motor or non-propeller drive systems may be used.

As illustrated , the motor 106 is clampedly attached to the motor mount box 602 such that the motor 106 can yaw relative to the beam 102. (See FIGS. 7, 8A and 8B). Yawing the motor 106 turns the watercraft. In the illustrated embodiments, the motor 106 is configured to be yawed by a steering mechanism 108 responsive to rider inputs. As illustrated, steering mechanism for the motor 106 can include a port arm extending from a port side of the motor 106 and a starboard arm extending from a starboard side of the motor 106. The port and starboard arms can each be configured to receive a control cord or cable 112*a*, 112*b* for a steering mechanism 108 as further described below.

In some embodiments, the motor 106 can include a transportable throttle control 130 (FIG. 1) such that a rider can control the throttle from substantially any position on the board section 100 or the beam 102. Preferably, the transportable throttle control 130 includes a cable 132 linking the motor 106 to a throttle input. The throttle input may be a squeeze grip, a foot pedal, a rotatable throttle input, or another input device. In some embodiments, the throttle input is a squeeze grip attached to a buoyant baton segment. In the event a rider drops the throttle input during operation of the watercraft, it will float and remain within easy reach of the rider. Preferably, the throttle input controls throttle of the motor 106 variably from idle to full throttle. Also, preferably, the throttle input is biased towards maintaining the throttle at idle such that if the throttle input is dropped (as is likely the case, for example, if a rider falls off of the watercraft), the motor 106 returns to idle. While the motor control is depicted as a mechanical cable 132 linking an input device 130 with the motor throttle, it is recognized that other transportable control devices, such as electronic devices or hydraulic devices may be used to control the throttle from several positions on the watercraft. Alternately, as discussed below with respect to FIG. 11, in other embodiments, one or more throttle controls at fixed positions on the watercraft can be used to control the throttle.

Figure 9:
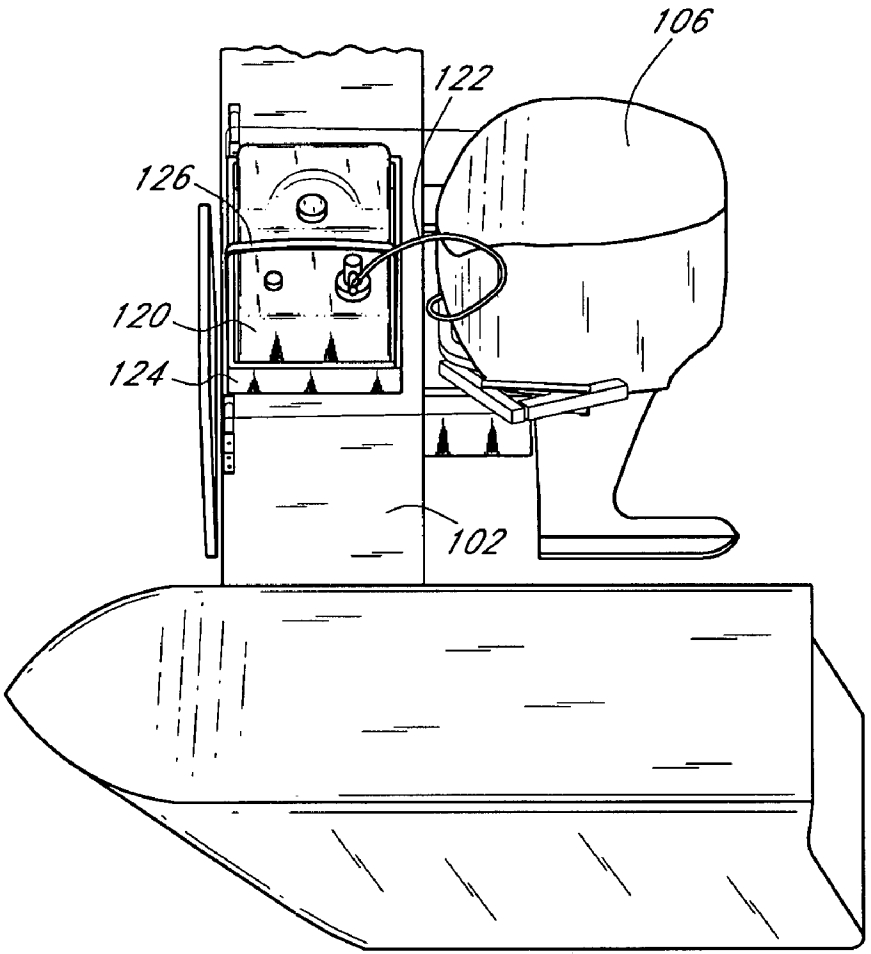
FIG. 9 is a side detail view of a fuel tank mount plate for a watercraft such as that illustrated in FIG. 1.

With reference to FIG. 9, the motor 106 can be a gasoline engine that receives a supply of gasoline from a fuel tank 120. The fuel tank 120 can be mounted to the beam 102 on a fuel tank mounting tray 124 and fluidly coupled to the motor 106 through a fuel hose 122 as illustrated in FIG. 9. A fuel tank hold down strap 126 such as, for example, an elasticized cord, adjustable woven strap, rubber strap or metal strap may be used to hold the fuel tank 120 to the mounting tray 124. In other embodiments, the fuel tank 120 can be mounted to a tray on one of the pontoons 104*a*, 104*b*. In still other embodiments, the fuel tank 120 can be mounted to a recessed portion on one of the pontoons 104*a*, 104*b* configured to hold the fuel tank 120. These alternate embodiments allow the beam 102 to remain relatively open so that it may be stood on or sat on by one or more riders.

Steering Mechanism

Figure 6A:
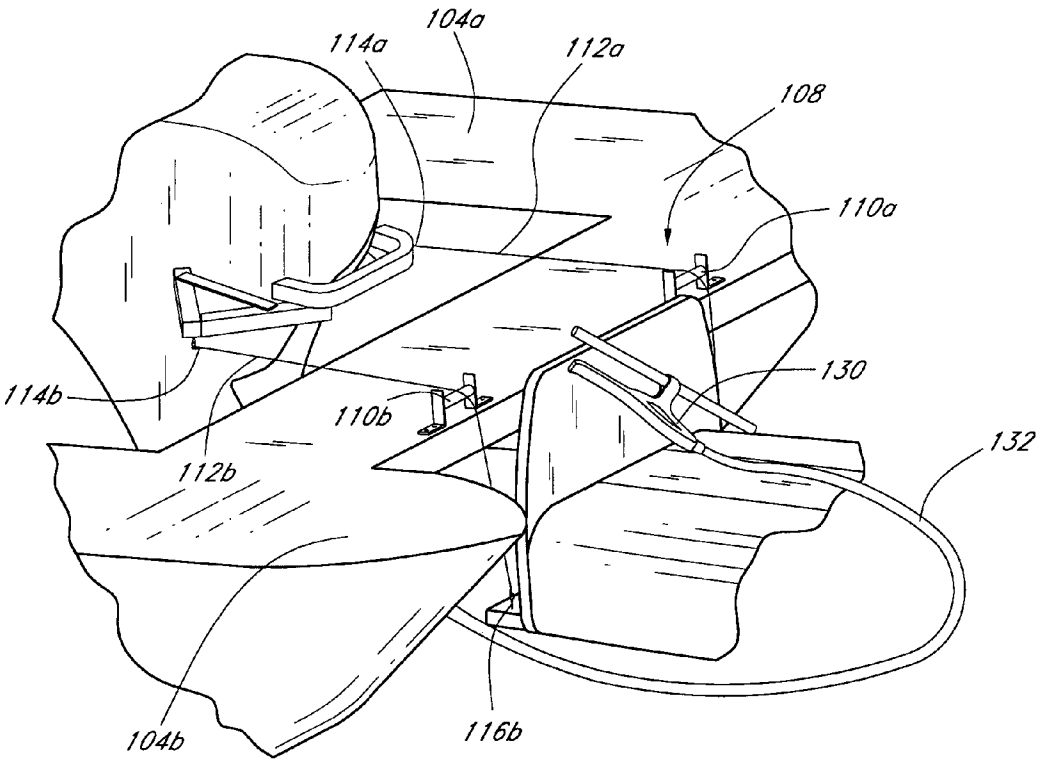
FIG. 6A is a perspective view of one embodiment of steering mechanism for use in a watercraft such as that shown in FIG. 1.
Figure 6B:
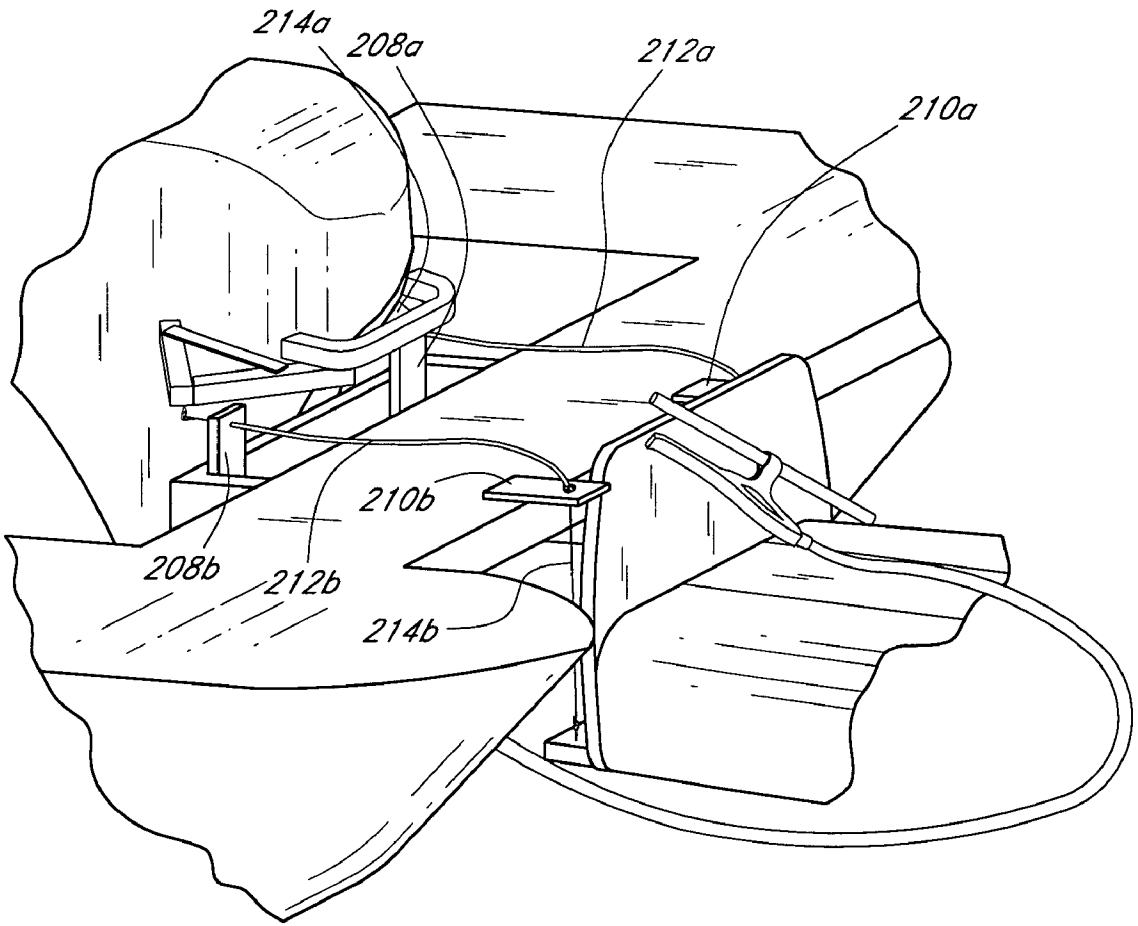
FIG. 6B is a perspective view of another embodiment of steering mechanism for use in a watercraft such as that shown in FIG. 1.

In various embodiments, watercrafts include a steering mechanism 108 to couple rotation of the board section 100 about its longitudinal axis with yaw of the motor 106. FIGS. 6A and 6B illustrate one embodiment of this steering mechanism. Advantageously, this coupling of board rotation with motor 106 yaw allows a board-based watercraft to retain the maneuverability and ride excitement of a board while incorporating enhanced stability features. In the illustrated embodiments, the steering mechanism 108 includes a first cord or cable 112*a*, a second cord or cable 112*b*, a first routing pulley 110*a*, and a second routing pulley 110*b*. In the illustrated embodiments, the first cord or cable 112*a* extend over the port side of the watercraft, and thus, can be termed the port cord or cable, and correspondingly, the second cord or cable 112*b* can be termed the starboard cord or cable. In other embodiments of steering mechanism, the cords or cables 112*a*, 112*b* can have different routing and connection locations.

The first cord or cable 112*a* is coupled to the board section 100 at a first end 116*a* of the first cord or cable 112*a*. Preferably, an eye or cleat near the aft end of a first side of the board section 100 provides a location for affixing the port cord or cable 112*a*. A second end 114*a* of the first cord or cable 112*a* can be coupled to the port side of the motor 106. A port arm, as described above, extending from the motor 106 can provide a location for coupling to the second end 114*a* of the first cord or cable 112*a*. The second cord or cable 112*b* can similarly be coupled to a second side of the aft end of the board section 100 at a first end 116*b* of the second cord or cable 112*b* and the starboard side of the motor 106 at a second end 114*b* of the second cord or cable 112*b*. It is recognized that in a steering mechanism 108 as described or depicted, either a cord such as a nylon rope, or a metal cable can be utilized. In some embodiments, further discussed below with respect to FIG. 6B, a sheathed cable, similar to those used for gear and brake actuation on bicycles, having an inner cable and an outer sheath can be used in the steering mechanism. The material chosen for the cable or cord should be selected to meet various criteria including being resistant to stretch when subjected to repeated tensile loads and being resistant to degradation and corrosion when used in a salt or freshwater environment. Various cords and cables currently used in sailboats and other nautical applications could be used in the steering mechanism 108.

In the illustrated embodiments, a first routing pulley 110*a* is mounted to the beam 102 generally in the path taken by the first cord or cable 112*a* when the board section 100 is in a substantially level orientation. The second routing pulley 110*b* can likewise be mounted to the beam 102 generally in the path taken by the second cord or cable 112*b* when the board section 100 is in a substantially level orientation. These routing pulleys 110*a*, 110*b* provide a low friction transition point between a generally vertical portion of the cord or cable 112*a*, 112*b* between the board section 100 and the routing pulley 110*a*, 110*b* and a generally horizontal portion of the cord or cable 112*a*, 112*b* between the routing pulley 110*a*, 110*b* and the motor 106. Advantageously, the routing pulleys 110*a*, 110*b* can allow smooth operation of the steering mechanism 108 and prevent the cord or cable 112*a*, 112*b* from becoming frayed through repeated contact with the beam 102. Preferably, the routing pulleys 110*a*, 110*b* are wide relative to the diameter of the cord or cable 112*a*, 112*b* to allow the cord or cable 112*a*, 112*b* to cross the routing pulleys 110*a*, 110*b* at varying locations and orientations when the steering mechanism 108 is in operation as the cords or cables 112*a*, 112*b* may tend to migrate as the motor 106 is yawed.

In embodiments of steering mechanism using sheathed cables, as illustrated in FIG. 6B, the sheathed cables can couple the motor 106 to the board section 100 without routing pulleys. The sheathed cables include outer sheaths 212*a*, 212*b*, and inner cables 214*a*, 214*b*. Brackets 208*a*, 208*b*, 210*a*, 210*b*, can retain the outer sheath 212*a*, 212*b* of each of the cables and orient the inner cable 214*a*, 214*b* towards the board section 100 or the motor 106.

Figure 7:
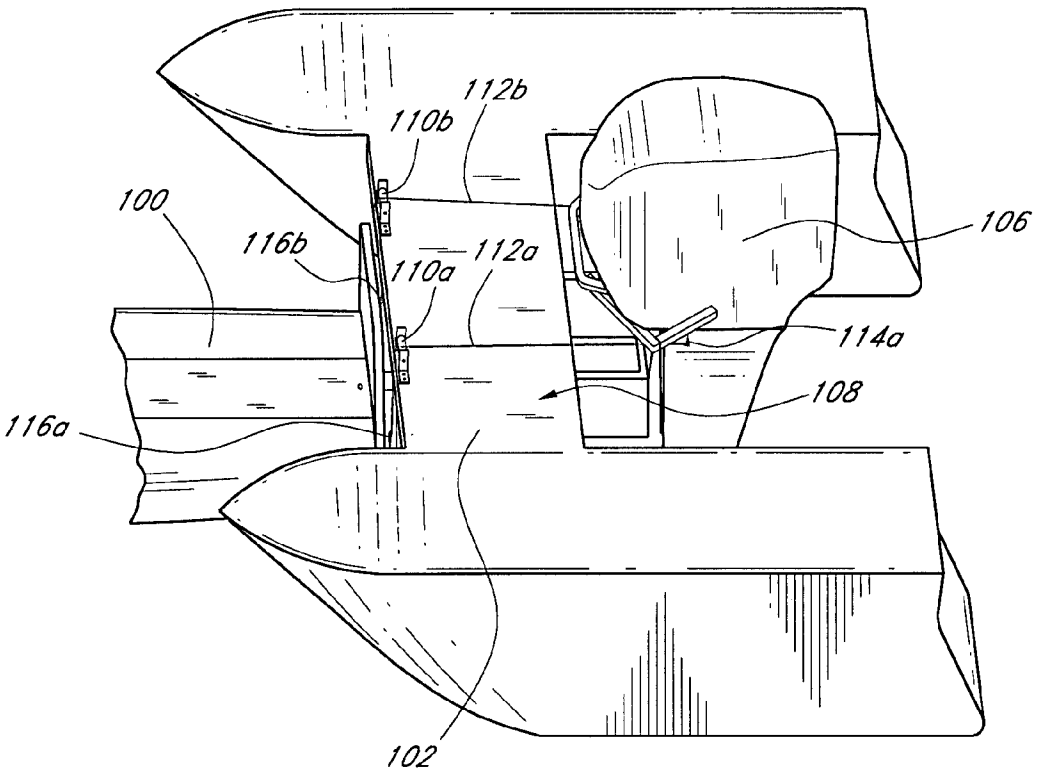
FIG. 7 is a side detail view of the watercraft of FIG. 1 in a straight steering configuration.
Figure 8A:
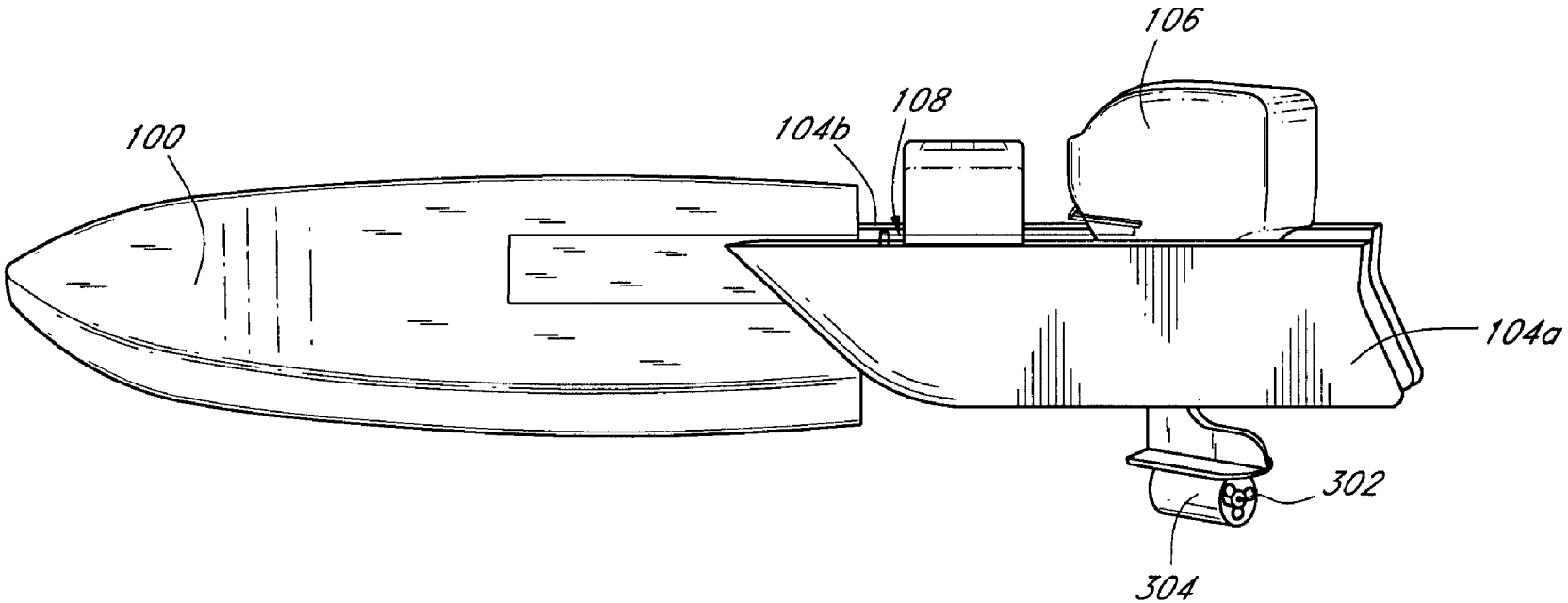
FIG. 8A is a side view of the watercraft of FIG. 1 in a port turn configuration.
Figure 8B:
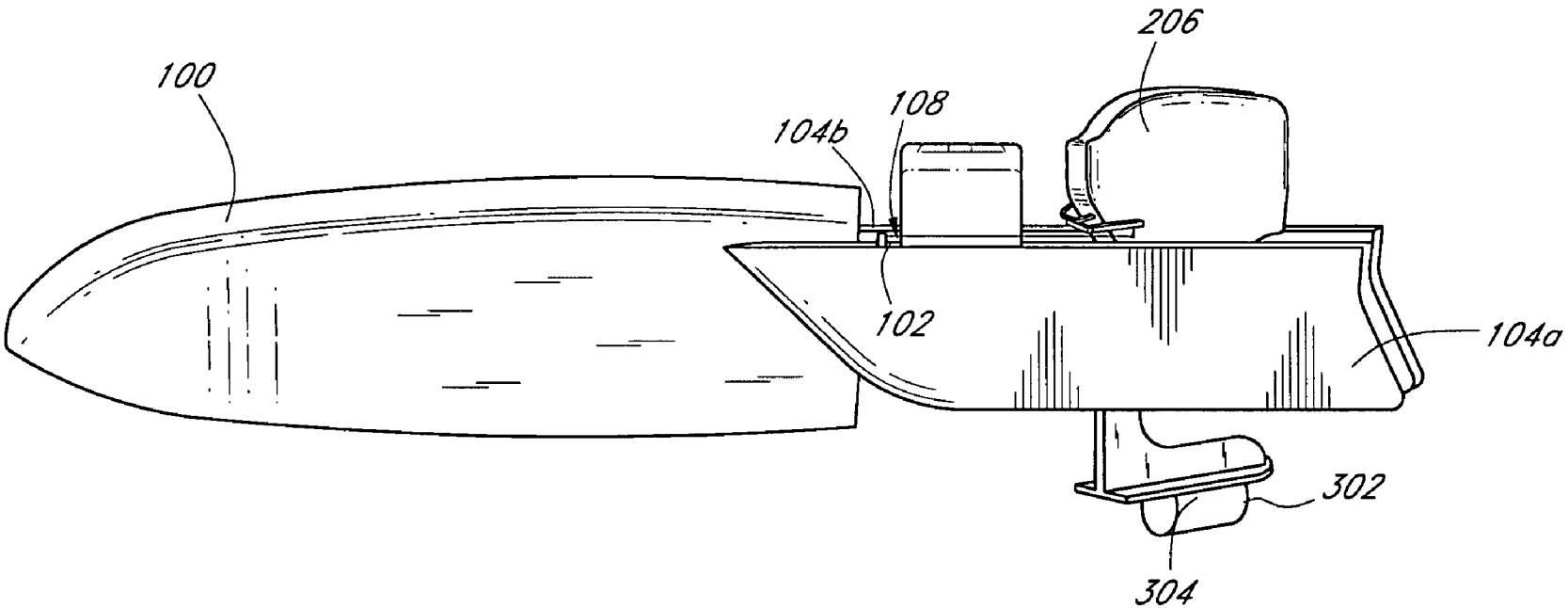
FIG. 8B is a side view of the watercraft of FIG. 1 in a starboard turn configuration.

The interconnection of board section 100 rotation and motor 106 yaw is illustrated in FIGS. 7, 8A and 8B, which illustrate an embodiment of watercraft in a straight ahead, port turn configuration and a starboard turn configuration respectively. In operation, a rider may steer by shifting weight to one side of the board section 100, thus rotating the board section 100 about its longitudinal axis such that one side of the board section 100 dips relative to the other side. This rotation of the board section 100 displaces the first ends of the cables or cords. This displacement of the first ends of the cords or cables likewise displaces the second ends 114*a*, 114*b* affixed to the motor 106, thus turning the motor 106. To make a turn to port, for example, a rider would shift weight on the board section 100 to lower the port side of the board section 100. The first end of the first cord or cable 112*a* would be displaced downward, thereby pulling the port arm of the motor 106 forward. The first end of the second cord or cable 112*b* would be displaced upward, thereby allowing the starboard arm on the motor 106 to move aft. The motor 106 would thus be yawed to turn the watercraft to port. To straighten the direction of travel of the watercraft, a rider would level the board section 100 about its longitudinal axis, thus allowing the motor 106 to return to a straight orientation. To turn to starboard, a rider would bank the board section 100 to starboard, thus turning the motor 106 to starboard. By increasing or decreasing the bank angle or amount of rotation of the board section 100 relative to level, the rider can control the radius of the turn taken by the watercraft. In various embodiments, a method of turning a watercraft by rotating a board section 100 is thus provided.

While the steering mechanism 108 has been depicted as a two cord system with two cable routing pulleys 110*a*, 110*b*, it is recognized that various other coupling assemblies could be used to coordinate the rotation of the board section 100 with the yawing of the motor 106. For example, a mechanical linkage including a plurality of links could be used. Alternately, rigid pushrods to transmit steering forces in compression could be substituted for the cables or cords which transmit the steering forces in tension. These alternatives are listed by way of example only, it is recognized that still other alternate steering mechanisms could be utilized in a watercraft as described herein. Further, it is recognized that it may be desirable in certain circumstances to lock the rotation of the board section 100, and thus the steering mechanism 108 in a straight-ahead position. It is contemplated that various cord or cable clamps could be added to the steering mechanism 108 to add this cable-locking aspect.

With reference to FIGS. 10 and 11, in some embodiments, the watercraft can be configured for seated riders. As noted above, in some embodiments, the board section 100 can include rails 160*a*, 160*b* to allow one or more passengers to kneel, sit, or lie on the upper surface of the board section 100. In other embodiments, illustrated in FIG. 11, the board section 100' can include a seat area 704 to allow a rider to sit on the board surface. As illustrated, the motor throttle control 702 can be mounted to a fixed position on the watercraft such as a pontoon for easy access by a seated rider. A seated rider can steer the watercraft by shifting weight on the board section 100' to bank the board section 100' as described above. Advantageously, it can be easier for a seated rider to learn to maneuver the watercraft as a seated rider will be less likely to lose balance. Additionally, a seated rider can enjoy a low-to-the water riding experience.

Another aspect of the embodiment of watercraft illustrated in FIG. 11 is that the board section 100' has been configured to fit closely between the pontoons. It can be desirable in certain embodiments that the board section 100' fits closely with the pontoons to minimize water spray to the upper surface of the pontoon section and possible water spray forward onto the board section. In other embodiments, various water blocking members such as flexible or semi-rigid rubber, plastic, or polymer skirts or shields can be positioned on the board section, the beam, or the pontoons to block water spray that would otherwise exit between the beam, the board section, and the pontoons. In other embodiments, the relative buoyancies of the board section 100' and pontoons can be adjusted such that the watercraft tends to operate at an attitude such that water spray between the board and pontoons is minimized.

Still another aspect of the embodiment of watercraft illustrated in FIG. 11 is that the board section 100' has increased width and thickness relative to the board section 100 embodiments illustrated in FIGS. 1-4. It is contemplated that board sections 100, 100' of various dimensions can be used in various embodiments of watercrafts described herein. It is noted that properties and dimensions of board section for a particular embodiment of watercraft can be configured for desired characteristics depending on various considerations including: the desired use environment (in some instances, a larger dimension board can be desirable for ocean, or rough water use), the board material (as noted above, the buoyancy of the board can be selected to achieve desired dynamic performance, also, the material of the board can affect the total weight of the watercraft, which can impact top speed and dynamic performance of the watercraft), the desired number of riders (where a rider and one or more passenger are contemplated to sit on the board section, it can be desirable to have a larger board surface with additional buoyancy).

Although these inventions have been disclosed in the context of certain preferred embodiments and examples, it will be understood by those skilled in the art that the present inventions extend beyond the specifically disclosed embodiments to other alternative embodiments and/or uses of the inventions and obvious modifications and equivalents thereof. Further, the various features of these inventions can be used alone, or in combination with other features of these inventions other than as expressly described above. Thus, it is intended that the scope of the present inventions herein disclosed should not be limited by the particular disclosed embodiments described above, but should be determined only by a fair reading of the claim set that follows.

What is claimed is:

1. A board-based motorized watercraft comprising:

a board section having a longitudinal axis and forming a bow of the watercraft;

a stabilization section of the watercraft comprising:

a starboard pontoon;

a port pontoon;

a beam spanning from the starboard pontoon to the port pontoon;

a motor mount box mounted to the beam, the motor mount box including a motor mount plate and providing a rotatable connection between the board section and the aft section of the watercraft such that the board section is rotatable about the longitudinal axis with respect to the aft section and such that the pontoons provide buoyancy and enhanced stability to the board section; and a motor pivotally mounted to the motor mount plate such that the motor is yawable with respect to the beam; and a steering mechanism for coupling a rotation of the board section relative to the beam section to a yaw angle of the motor relative to the beam such that rotation of the board about its longitudinal axis yaws the motor in a direction corresponding to a desired direction of a turn such that the watercraft provides a board-like riding experience; the steering mechanism comprising:

a port cable having a first end and a second end, wherein the first end of the port cable is coupled to a port side of the board section and the second end of the port cable is coupled to the port side of the motor;

a starboard cable having a first end and a second end, wherein the first end of the starboard cable is coupled to a starboard side of the board section and the second end of the starboard cable is coupled to the starboard side of the motor;

a port cable router mounted to the beam and configured to route the port cable between the board section and the motor; and a starboard cable router mounted to the beam and configured to route the starboard cable between the board section and the motor.

2. A motorized watercraft comprising:

a board section;

at least one pontoon;

a beam connected to the at least one pontoon;

a motor mounted to the beam; and a steering mechanism for yawing the motor to steer the watercraft; the steering mechanism comprising:

a port cable having a first end and a second end, wherein the first end of the port cable is coupled to a port side of the board section and the second end of the port cable is coupled to the port side of the motor;

a starboard cable having a first end and a second end, wherein the first end of the starboard cable is coupled to a starboard side of the board section and the second end of the starboard cable is coupled to the starboard side of the motor;

a port cable router mounted to the beam and configured to route the port cable between the board section and the motor; and a starboard cable router mounted to the beam and configured to route the starboard cable between the board section and the motor;

wherein the board section is rotatably mounted with respect to the beam such that the board section is rotatable about a longitudinal axis of the board; and wherein the steering mechanism couples the rotation of the board section with the yaw of the motor such that rotating the board about its longitudinal axis yaws the motor.

3. The motorized watercraft of claim 2, wherein the at least one pontoon comprises two pontoons.

4. The motorized watercraft of claim 2, wherein that at least one pontoon comprises a buoyant foam material.

5. The motorized watercraft of claim 2, further comprising a motor mount coupled to the beam.

6. The motorized watercraft of claim 5, wherein the motor mount comprises a motor mount box, and wherein the board is pivotally mounted to the motor mount box.

7. The motorized watercraft of claim 2, wherein the port cable router comprises a pulley and the starboard cable router comprises a pulley.

8. The motorized watercraft of claim 2, wherein the port cable router comprises a mounting bracket and the starboard cable router comprises a mounting bracket.

9. The motorized watercraft of claim 2, wherein the steering mechanism comprises a mechanical linkage.

10. The motorized watercraft of claim 2, wherein the board section is removably connected to the beam.

11. The motorized watercraft of claim 2, wherein the board section comprises a tubular spine running substantially parallel to the longitudinal axis of the board.

12. The motorized watercraft of claim 11, wherein the tubular spine is fixedly connected to the board section and rotatably coupled to the beam.

13. The motorized watercraft of claim 12, further comprising a mount box coupled to the beam and rotatably coupled to the tubular spine.

14. The motorized watercraft of claim 2, wherein the motor comprises an outboard motor having a propeller drive.

15. The motorized watercraft of claim 14, wherein the motor further comprises a propeller guard.

* * * * *